US006834175B2

(12) United States Patent
Murayama et al.

(10) Patent No.: US 6,834,175 B2
(45) Date of Patent: Dec. 21, 2004

(54) DEVELOPER AGITATING MEMBER

(75) Inventors: Kazunari Murayama, Shizuoka (JP); Masahide Kinoshita, Shizuoka (JP); Atsushi Numagami, Kanagawa (JP); Seiji Yamaguchi, Shizuoka (JP); Takahito Ueno, Shizuoka (JP); Masao Uyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/384,636

(22) Filed: Mar. 11, 2003

(65) Prior Publication Data

US 2003/0175050 A1 Sep. 18, 2003

(30) Foreign Application Priority Data

Mar. 14, 2002 (JP) ..... 2002-070520

(51) Int. Cl.[7] ..... G03G 15/08

(52) U.S. Cl. ..... 399/256; 366/241; 366/279; 366/342; 399/263

(58) Field of Search ..... 399/256, 254, 399/263, 119, 111; 366/241, 244, 279, 342, 343

(56) References Cited

U.S. PATENT DOCUMENTS

| | | | | |
|---|---|---|---|---|
| 4,659,230 A | * | 4/1987 | Son et al. | 366/343 |
| 5,095,335 A | | 3/1992 | Watanabe et al. | 399/111 |
| 5,283,616 A | | 2/1994 | Numagami et al. | 399/111 |
| 5,383,011 A | | 1/1995 | Numagami et al. | 399/358 |
| 5,500,714 A | | 3/1996 | Yashiro et al. | 399/111 |
| 5,543,898 A | | 8/1996 | Shishido et al. | 399/111 |
| 5,572,297 A | * | 11/1996 | Kawashima | 399/257 |
| 5,585,895 A | | 12/1996 | Yashiro et al. | 399/103 |
| 5,589,918 A | | 12/1996 | Oshida et al. | 399/114 |
| 5,617,579 A | | 4/1997 | Yashiro et al. | 399/114 |
| 5,682,574 A | | 10/1997 | Oshida et al. | 399/64 |
| 5,689,774 A | | 11/1997 | Shishido et al. | 399/111 |
| 5,717,973 A | * | 2/1998 | Endoh et al. | 399/29 |
| 5,758,238 A | * | 5/1998 | Mordenga et al. | 399/256 |
| 5,768,658 A | | 6/1998 | Watanabe et al. | 399/111 |
| 5,768,660 A | * | 6/1998 | Kurihara et al. | 399/111 |
| 5,790,923 A | | 8/1998 | Oguma et al. | 399/106 |
| 5,920,753 A | | 7/1999 | Sasaki et al. | 399/111 |
| 5,937,239 A | | 8/1999 | Watanabe et al. | 399/111 |
| 5,937,242 A | | 8/1999 | Yokoyama et al. | 399/114 |
| 5,966,566 A | | 10/1999 | Odagawa et al. | 399/109 |
| 5,966,568 A | | 10/1999 | Numagami et al. | 399/111 |
| 6,006,058 A | | 12/1999 | Watanabe et al. | 399/167 |
| 6,016,413 A | | 1/2000 | Yokoyama et al. | 399/113 |
| 6,029,032 A | | 2/2000 | Watanabe et al. | 399/107 |
| 6,097,908 A | | 8/2000 | Uchiyama et al. | 399/111 |
| 6,097,909 A | | 8/2000 | Watanabe et al. | 399/111 |
| 6,101,354 A | | 8/2000 | Nakagawa et al. | 399/225 |
| 6,118,960 A | | 9/2000 | Nakagawa et al. | 399/111 |
| 6,122,472 A | * | 9/2000 | Sako et al. | 399/254 |
| 6,131,007 A | | 10/2000 | Yamaguchi et al. | 399/256 |
| 6,131,011 A | | 10/2000 | Kojima et al. | 399/351 |
| 6,157,792 A | | 12/2000 | Mori et al. | 399/24 |
| 6,169,866 B1 | | 1/2001 | Watanabe et al. | 399/111 |
| 6,236,821 B1 | | 5/2001 | Yokoyama et al. | 399/113 |

(List continued on next page.)

FOREIGN PATENT DOCUMENTS

| | | | |
|---|---|---|---|
| JP | 05-072894 | * | 3/1993 |
| JP | 06-167876 | * | 6/1994 |
| JP | 07-013420 | * | 1/1995 |

*Primary Examiner*—Sophia S. Chen
(74) *Attorney, Agent, or Firm*—Fitzpatrick, Cella, Harper & Scinto

(57) ABSTRACT

The developer agitating member has a shaft portion, a spiral rib and an inclined rib protruding from the outer peripheral surface of the shaft portion and provided in the spiral rib in the axial direction of the shaft portion. As a result, in a developing apparatus, a process cartridge and an image forming apparatus, the developer agitating member can efficiently agitate and convey a developer.

17 Claims, 5 Drawing Sheets

U.S. PATENT DOCUMENTS

| | | | | |
|---|---|---|---|---|
| 6,246,848 | B1 | 6/2001 | Morinaga et al. | 399/106 |
| 6,246,849 | B1 | 6/2001 | Yokoyama et al. | 399/117 |
| 6,266,500 | B1 | 7/2001 | Numagami et al. | 399/104 |
| 6,266,503 | B1 | 7/2001 | Murayama et al. | 399/117 |
| 6,272,299 | B1 | 8/2001 | Numagami et al. | 399/111 |
| 6,289,189 | B1 | 9/2001 | Numagami et al. | 399/111 |
| 6,298,217 | B1 | 10/2001 | Murayama et al. | 399/358 |
| 6,314,266 | B1 | 11/2001 | Murayama et al. | 399/353 |
| 6,330,409 | B1 | 12/2001 | Watanabe et al. | 399/111 |
| 6,343,193 | B1 | 1/2002 | Matsumoto et al. | 399/27 |
| 6,385,416 | B1 | 5/2002 | Horikawa et al. | 399/111 |
| 6,404,996 | B1 | 6/2002 | Mori et al. | 399/24 |
| 6,442,359 | B1 | 8/2002 | Numagami et al. | 399/111 |
| 6,463,233 | B2 | 10/2002 | Kojima et al. | 399/111 |
| 6,496,664 | B1 | 12/2002 | Ogata et al. | 399/62 |
| 2002/0057924 | A1 | 5/2002 | Ueno et al. | 399/117 |
| 2002/0057928 | A1 | 5/2002 | Yasumoto et al. | 399/167 |
| 2002/0085854 | A1 | 7/2002 | Numagami et al. | 399/90 |

* cited by examiner

DEVELOPER AGITATING MEMBER

BACKGROUND OF THE INVENTION

1. Field of the Invention

This invention relates to an agitating and conveying member for agitating and conveying a developer contained in a developer containing portion, and a developing apparatus and a process cartridge provided with the agitating and conveying member, and an image forming apparatus provided with the developing apparatus or the process cartridge.

2. Related Background Art

Heretofore, in an image forming apparatus of this kind, there has been adopted a process cartridge system in which an electrophotographic photosensitive member and charging means, developing means, cleaning means or the like are integrally made into a cartridge which is made detachably mountable on an image forming apparatus main body.

Operability has been improved by this cartridge system, and it has become possible for a user himself to effect the maintenance of the above-mentioned process means easily. So, this cartridge system is widely used in image forming apparatus main bodies.

Also, there has been realized a cartridge construction in which process means are grouped into ones of long life and ones of short life and the respective process means are made into a cartridge usable in conformity with the life of main process means. For example, there has been adopted a developing cartridge in which a toner containing portion and developing means are constructed integrally with each other, or a drum cartridge in which an electrophotographic photosensitive member and charging means or cleaning means are constructed integrally with each other, or the like.

Further, with the lengthened life of a developing unit with which developing means is constructed integrally, there has also been adopted a method of supplying only a toner consumed in conformity with image forming, and independently interchanging an interchangeable toner cartridge.

The toner to be supplied from the toner cartridge to the developing unit is agitated by agitating means in a developing container so that it may become capable of developing before being used for developing, and is supplied to a developing roller portion.

Particularly, in a high-speed image forming apparatus improved in printing capability, it is necessary that the toner supplied into the aforementioned developing container be supplied to the developing roller in a state capable of developing immediately after it has been agitated within a short time of several seconds.

SUMMARY OF THE INVENTION

It is an object of the present invention to provide an agitating and conveying member, a developing apparatus, a process cartridge and an image forming apparatus which can efficiently agitate and convey a developer.

It is another object of the present invention to provide an agitating and conveying member, a developing apparatus, a process cartridge and an image forming apparatus which can efficiently agitate and convey a developer even in a high-speed image forming apparatus.

It is another object of the present invention to provide an agitating and conveying member for agitating and conveying a developer contained in a developer containing portion, the agitating and conveying member having a shaft portion, a spiral rib protruding from the outer peripheral surface of the shaft portion and having a spiral shape, and an inclined rib protruding from the outer peripheral surface of the shaft portion and provided in the spiral rib in the axial direction of the shaft portion, the inclined rib being provided with the distal end thereof inclined in the direction of rotation of the shaft portion with respect to the radial direction of the shaft portion, the inclined rib extending along a direction substantially orthogonal to the spiral angle of the spiral rib.

It is another object of the present invention to provide a developing apparatus detachably mountable on an image forming apparatus main body, the developing apparatus having a developing member for developing a latent image formed on an electrophotographic photosensitive member, a developer containing portion containing therein a developer for developing the latent image on the electrophotographic photosensitive member, and an agitating and conveying member for agitating and conveying the developer contained in the developer containing portion, the agitating and conveying member having a shaft portion, a spiral rib protruding from the outer peripheral surface of the shaft portion and having a spiral shape, and an inclined rib protruding from the outer peripheral surface of the shaft portion and provided in the spiral rib in the axial direction of the shaft portion, the inclined rib being provided with the distal end thereof inclined in the direction of rotation of the shaft portion with respect to the radial direction of the shaft portion, the inclined rib extending along a direction substantially orthogonal to the spiral angle of the spiral rib.

It is another object of the present invention to provide a process cartridge detachably mountable on an image forming apparatus main body, the process cartridge having an electrophotographic photosensitive member, a developing member for developing a latent image formed on the electrophotographic photosensitive member, a developer containing portion containing therein a developer for developing the latent image on the electrophotographic photosensitive member, and an agitating and conveying member for agitating and conveying the developer contained in the developer containing portion, the agitating and conveying member having a shaft portion, a spiral rib protruding from the outer peripheral surface of the shaft portion and having a spiral shape, and an inclined rib protruding from the outer peripheral surface of the shaft portion and provided in the spiral rib in the axial direction of the shaft portion, the inclined rib being provided with the distal end thereof inclined in the direction of rotation of the shaft portion with respect to the radial direction of the shaft portion, the inclined rib extending along a direction substantially orthogonal to the spiral angle of the spiral rib.

It is another object of the present invention to provide an image forming apparatus on which a developing apparatus is detachably mountable and for forming an image on a recording medium, the image forming apparatus having (i) a mounting portion, (ii) a developing apparatus detachably mounted on the mounting portion, and having a developing member for developing a latent image formed on an electrophotographic photosensitive member, a developer containing portion containing therein a developer for developing the latent image on the electrophotographic photosensitive member, and an agitating and conveying member for agitating and conveying the developer contained in the developer containing portion, the agitating and conveying member having a shaft portion, a spiral rib protruding from the outer peripheral surface of the shaft portion and having a spiral shape, and an inclined rib protruding from the outer peripheral surface of the shaft portion and provided in the spiral rib in the axial direction of the shaft portion, the inclined rib being provided with the distal end thereof inclined in the direction of rotation of the shaft portion with respect to the radial direction of the shaft portion, the inclined rib extending along a direction substantially orthogonal to the spiral angle of the spiral rib, and (iii) transporting means for transporting the recording medium.

It is another object of the present invention to provide an image forming apparatus on which a process cartridge is detachably mountable and for forming an image on a recording medium, the image forming apparatus having (i) a mounting portion, (ii) a process cartridge detachably mounted on the mounting portion, and having an electrophotographic photosensitive member, a developing member for developing a latent image formed on the electrophotographic photosensitive member, a developer containing portion containing therein a developer for developing the latent image on the electrophotographic photosensitive member, and an agitating and conveying member for agitating and conveying the developer contained in the developer containing portion, the agitating and conveying member having a shaft portion, a spiral rib protruding from the outer peripheral surface of the shaft portion and having a spiral shape, and an inclined rib protruding from the outer peripheral surface of the shaft portion and provided in the spiral rib in the axial direction of the shaft portion, the inclined rib being provided with the distal end thereof inclined in the direction of rotation of the shaft portion with respect to the radial direction of the shaft portion, the inclined rib extending along a direction substantially orthogonal to the spiral angle of the spiral rib, and (iii) transporting means for transporting the recording medium.

DESCRIPTION OF THE PREFERRED EMBODIMENTS

Some preferred embodiments of this invention will hereinafter be described in detail by way of example with reference to the drawings. However, the dimensions, materials, shapes and relative arrangements of constituent parts described in these embodiments are to be suitably changed depending on the construction and various conditions of an apparatus to which the invention is applied, and are not intended to restrict the scope of this invention to the following embodiments.

Herein, image forming apparatuses are apparatuses for forming an image on a recording medium (transfer material) by the use of an electrophotographic image forming process, and include, for example, an electrophotographic copying machine, an electrophotographic printer (such as an LED printer or a laser beam printer), an electrophotographic facsimile apparatus and an electrophotographic word processor.

Also, a process cartridge refers to at least developing means and an electrophotographic photosensitive drum which is an image bearing member integrally made into a cartridge, which is made detachably mountable on an image forming apparatus main body. Also, a developing apparatus refers to developing means integrally made into a cartridge, which is made detachably mountable with respect to the image forming apparatus main body. Also, an agitating and conveying member, in the present embodiment, agitates and conveys a toner as powder, but this is not restrictive.

Also, in the following description, a longitudinal direction implies a direction orthogonal to the transport direction of a recording medium 52, and more particularly to the same direction as the axial direction of an electrophotographic photosensitive member (hereinafter referred to as the photosensitive drum 2). The terms right and left are the right and left directions as viewed from the transport direction of the recording medium 52. Further, the terms upper and lower are the upper and lower positions in the mounted state of the cartridge.

<Description of the Whole of the Image Forming Apparatus>

The general construction of a color electrophotographic image forming apparatus as the image forming apparatus will first be schematically described with reference to FIG. 1.

Figure 1:
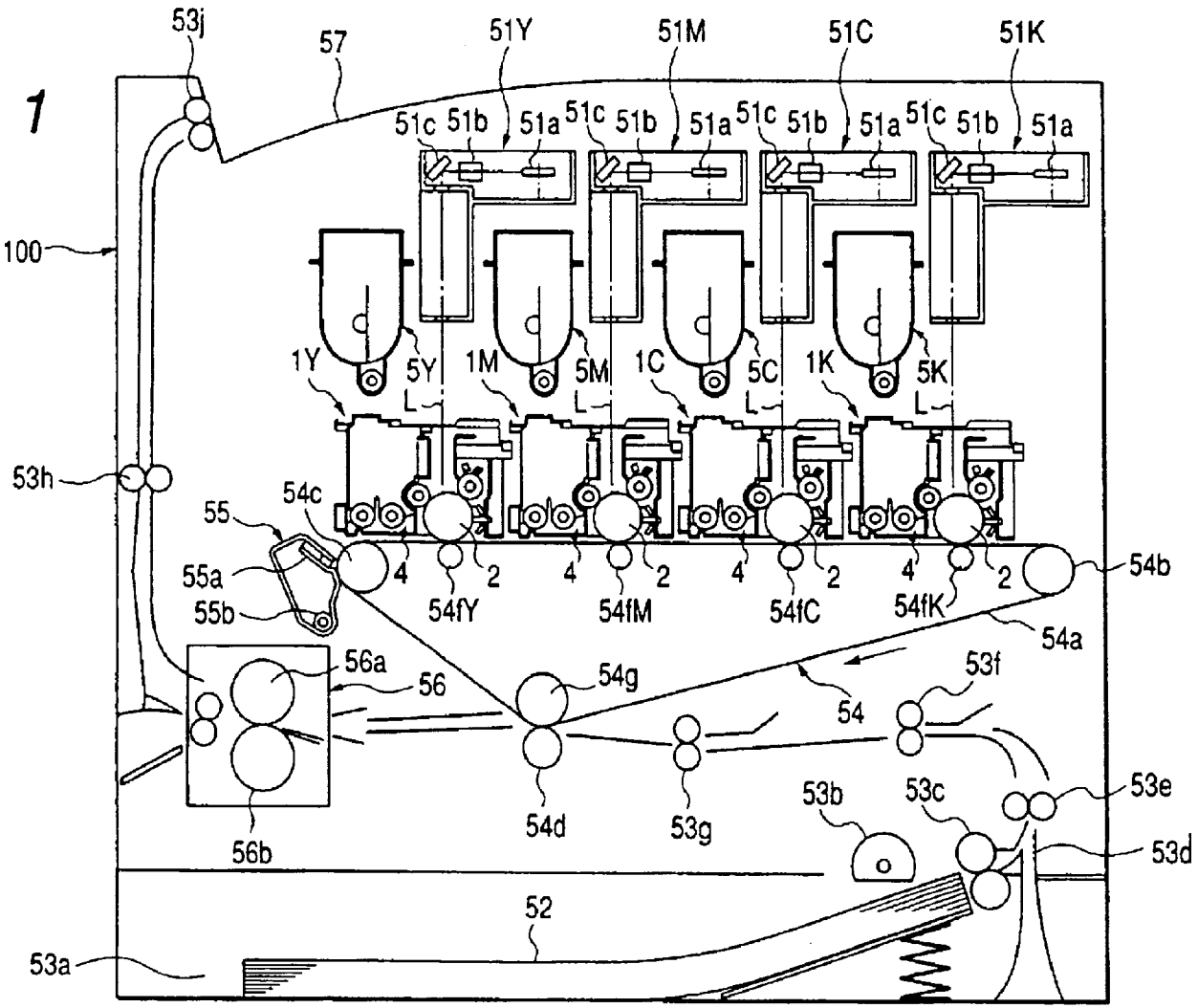
FIG. 1 is a schematic cross-sectional view of an image forming apparatus main body according to an embodiment of the present invention.
Figure 2:
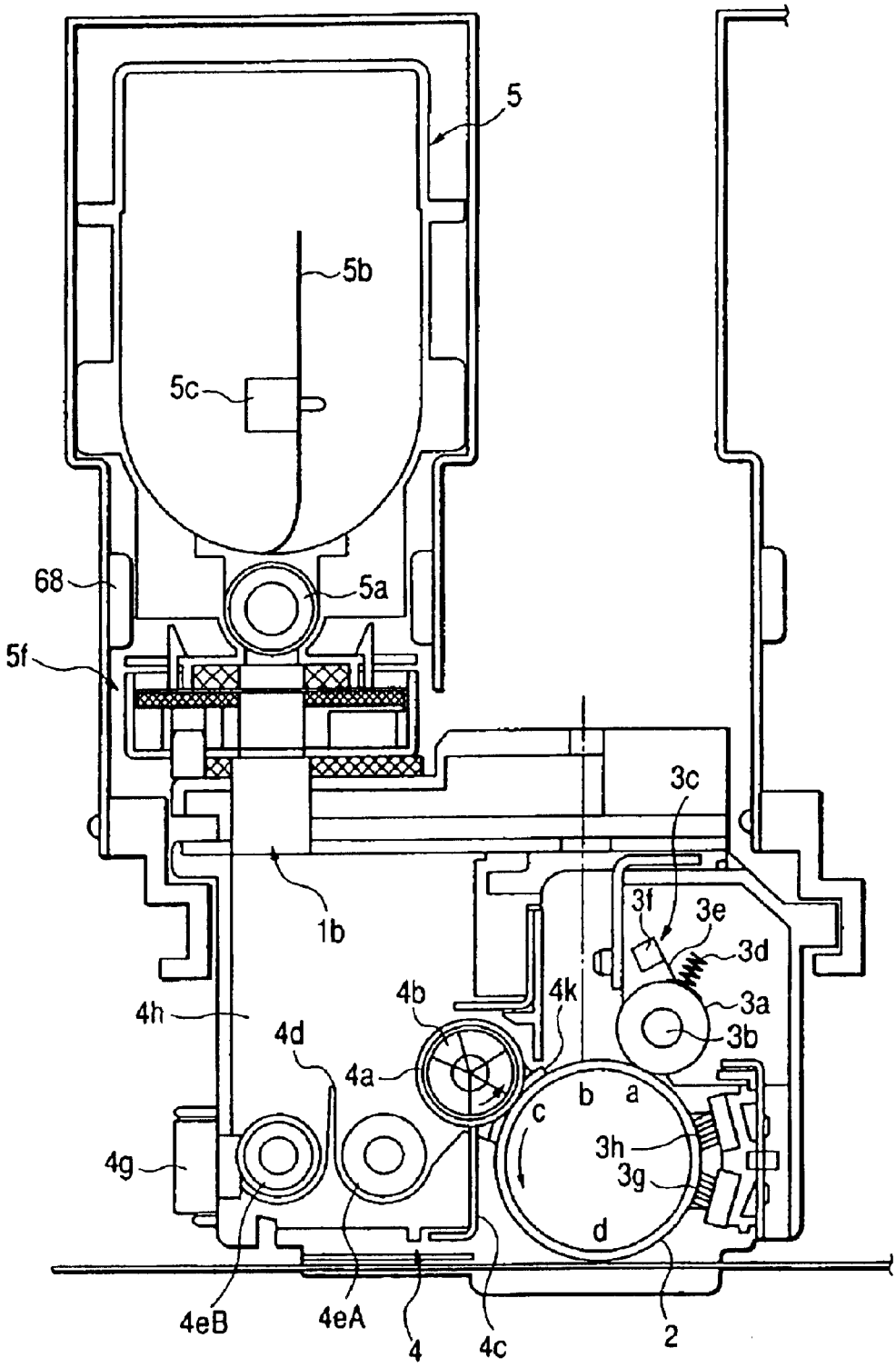
FIG. 2 is a schematic cross-sectional view of a process cartridge and a toner supply container according to an embodiment of the present invention.
Figure 3:
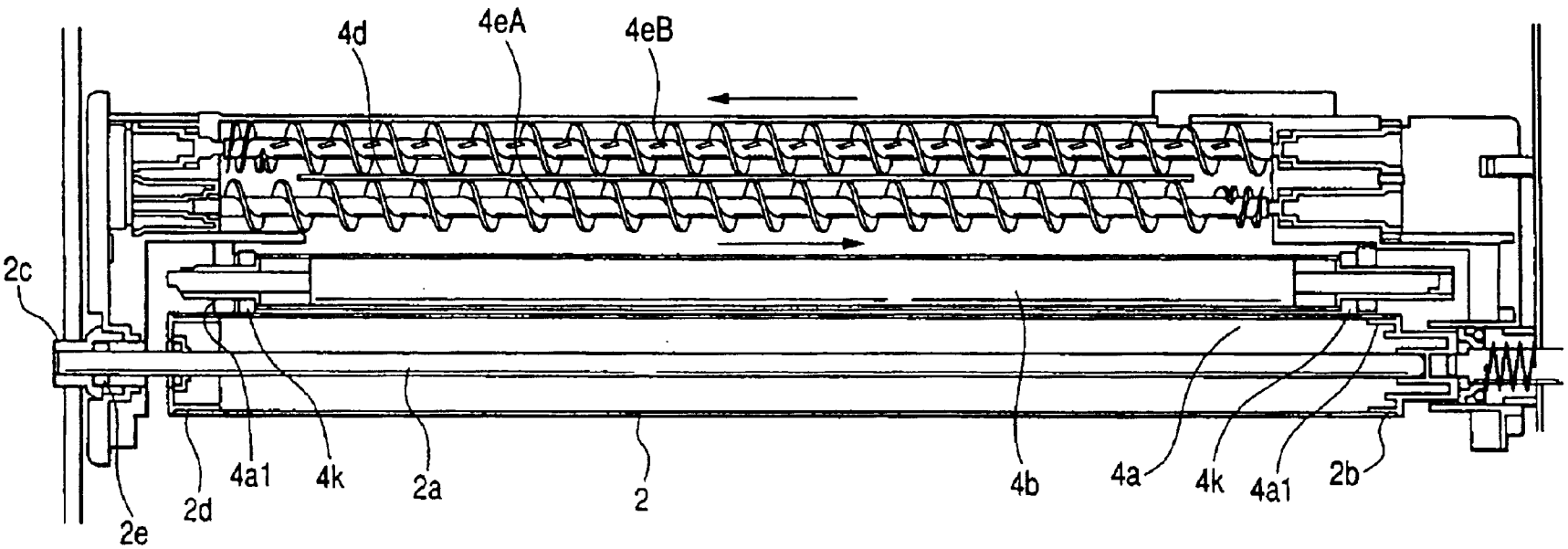
FIG. 3 is a schematic, lengthwise cross-sectional view of the process cartridge according to the embodiment of the present invention.

FIG. 1 is an illustration of the general construction of a color laser beam printer which is a form of a color image forming apparatus. Also, FIG. 2 is a schematic cross-sectional view of a process cartridge and a toner supply container, and FIG. 3 is a schematic, lengthwise cross-sectional view of the process cartridge.

The image forming portion of this color laser beam printer having image forming means is such that four process cartridges 1Y, 1M, 1C and 1K (yellow, magenta, cyan and black) provided with photosensitive drums 2, which are image bearing members, and exposure means 51Y, 51M, 51C and 51K (laser beam optical scanning systems), corresponding to the respective colors and above the process cartridges 1Y, 1M, 1C and 1K, are juxtaposed in parallel.

Below the above-described image forming portion, there are disposed feeding means for feeding out the recording medium 52, an intermediate transfer belt 54*a* to which toner images formed on the photosensitive drums 2 are transferred, and a secondary transfer roller 54*d* for transferring the toner images on the intermediate transfer belt 54*a* to the recording medium 52.

There are further disposed fixing means for fixing the toner images transferred to the recording medium 52, and delivery means for delivering the recording medium 52 out of the image forming apparatus and stacking it.

As the recording medium 52, use is made, for example, of paper, an OHP sheet or cloth.

The image forming apparatus according to the present embodiment is a cleanerless system apparatus, and any untransferred residual toners on the photosensitive drums 2 are introduced into developing means, and cleaners exclusively for use for collecting and storing the untransferred toners are not disposed in the process cartridges.

The construction of each portion of the above-described image forming apparatus will now be described in detail.

<Sheet Feeding Portion>

A sheet feeding portion serves to feed the recording media 52 to the image forming portion, and is comprised chiefly of a feed cassette 53*a* stacking a plurality of recording mediums 52 thereon, a feed roller 53*b*, double-feed preventing retard rollers 53*c*, a feed guide 53*d* and registration rollers 53*g*.

The feed roller 53*b* is rotatably driven in conformity with an image forming operation to thereby separate and feed the recording media 52 in the feed cassette 53*a* one by one. The recording medium 52 is guided by the feed guide 53*d* and is transported to the registration rollers 53*g* via transport rollers 53*e* and 53*f*.

Immediately after the recording medium 52 has been transported, the registration rollers 53*g* are stopped from rotating, and the recording medium 52 has its skew feed corrected by striking against the nip portion between the registration rollers.

During the image forming operation, the registration rollers 53*g* perform the non-rotating operation of making the recording medium 52 stop and stand by and the rotating operation of transporting the recording medium 52 toward the intermediate transfer belt 54*a* at a predetermined sequence. Then at the transferring step which is the next step, the registration rollers effect the alignment of the toner image and the recording medium 52.

<Process Cartridge>

The process cartridges 1Y, 1M, 1C and 1K have charging means and developing means disposed and integrally constructed around the photosensitive drums 2 which are image bearing members. These process cartridges can be easily detached with respect to the image forming apparatus main body by a user, and can be interchanged when the photosensitive drums 2 have come to the end of their life.

In the present embodiment, the design is made such that when for example, the number of revolutions of a photosensitive drum 2 is counted and exceeds a predetermined count number, the user is informed that the process cartridge has come to the end of its life.

Each of the photosensitive drums 2 in the present embodiment is a negatively charged organic photosensitive member, and has a usually used photosensitive layer on an aluminum drum base having a diameter of about 30 mm. A charge injection layer is provided on the outermost layer of the drum. The photosensitive drum is rotatably driven at a predetermined process speed, in the present embodiment, about 117 mn/sec.

As the charge injection layer, use is made of a coating layer of a material consisting of a binder of insulative resin and, e.g., super-fine particles of $SnO_2$ as electrically conductive fine particles dispersed therein.

As shown in FIG. 3, a drum flange 2*b* is fixed to the inner end portion of the photosensitive drum 2, and a non-driving flange 2*d* is fixed to this side end portion thereof. A drum shaft 2*a* extends through the centers of the drum flange 2*b* and the non-driving flange 2*d*. The drum shaft 2*a*, the drum flange 2*b* and the non-driving flange 2*d* are rotated as a unit. That is, the photosensitive drum 2 is rotated about the axis of the drum shaft 2*a*.

This side end portion of the drum shaft 2*a* is rotatably supported by a bearing 2*e*, which is fixed to a bearing case 2*c*. The bearing case 2*c* in turn is fixed to the frame of the process cartridge.

<Charging Means>

The charging means uses a contact charging method. In the present embodiment, a charging roller 3*a* is used as a charging member.

As shown in FIG. 2, this charging roller 3*a* has the opposite end portion of its mandrel 3*b* rotatably held by bearing members. Also, the charging roller 3*a* is biased toward the photosensitive drum by a push spring 3*d* and is brought into pressure contact with the surface of the photosensitive drum 2 with a predetermined pressure force. The charging roller 3*a* is rotated following the rotation of the photosensitive drum 2.

The reference character 3*c* designates a charging roller cleaning member, and in the present embodiment, it has flexible cleaning film 3*e*. This cleaning film 3*e* is disposed parallel to the longitudinal direction of the charging roller 3*a* and has one end thereof fixed to a support member 3*f* reciprocally movable by a predetermined amount relative to the aforementioned longitudinal direction. The cleaning film 3*e* is disposed so as to form a contact nip with the charging roller 3*a* on the surface thereof near the free end of the cleaning film 3*e*. The support member 3*f* is reciprocally moved by a predetermined amount in the longitudinal direction thereof by driving means, not shown, and the surface of the charging roller is rubbed by the cleaning film 3*e*. As a result, any adhering substances (such as minute powder toner and extraneous additive) on the surface of the charging roller are removed.

The image forming apparatus according to the present embodiment adopts a cleanerless system. This cleanerless system will hereinafter be described.

<Cleanerless System>

The epitome of the cleanerless system in the image forming apparatus according to the present embodiment will first be described. Any untransferred toner on the photosensitive drum 2 after transfer is passed through a charging portion a and an exposure portion b with the rotation of the photosensitive drum and is brought to a developing portion c. This toner is then collected simultaneously with developing by a developing apparatus.

The untransferred toner on the surface of the photosensitive drum 2 passes through the exposure portion b and therefore, the exposing step is carried out from on the untransferred toner. Since, however, the amount of the untransferred toner on the surface of the photosensitive drum 2 is small, any great influence does not appear.

In the untransferred toner, however, there are mixed together a toner of a regular (charge) polarity, a toner of the opposite (charge) polarity (reversed toner), and a toner of a small charged amount. Consequently, when passing through the charging portion a, the reversed toner and the toner of a small charged amount adhere to the charging roller 3*a*, whereby the charging roller 3*a* is more contaminated with more toner than is allowable and bad charging occurs.

Also, to cause the cleaning (removal) simultaneous with developing of the untransferred toner on the surface of the photosensitive drum by the developing apparatus to be effected effectively, it is necessary that the charged polarity of the untransferred toner on the photosensitive drum brought to the developing portion c be the regular polarity and the charged amount thereof be such a charged amount that the electrostatic latent image on the photosensitive drum can be developed by the developing apparatus. This is because the reversed toner and the toner inappropriate in charged amount cannot be removed and collected from on the photosensitive drum into the developing apparatus, thus causing the formation of a poor image.

Also, with the recent diversification of users' needs, a great deal of untransferred toner occurs at once due to a continuous printing operation for images of high coverage such as photographic images, to thereby further exacerbate the problem as noted above.

So, in the present embodiment, untransferred toner (residual developer image) uniformizing means 3*g* for uniformizing the untransferred toner on the photosensitive drum 2 is provided at a location downstream of a transfer portion d with respect to the photosensitive drum. Also, toner (developer) charging control means 3*h* for uniformizing the charged polarity of the untransferred toner to the negative polarity, which is the regular polarity, is provided at a location downstream of the untransferred toner uniformizing means 3*g* with respect to the direction of rotation of the photosensitive drum and upstream of the charging portion a with respect to the direction of rotation of the photosensitive drum.

By the provision of the untransferred toner uniformizing means 3*g*, the untransferred toner positioned in a pattern on the photosensitive drum that is brought from the transfer portion d to the toner charging control means 3*h*, even if it is great in quantity, is dispersed and distributed over the surface of the photosensitive drum, so as to form no pattern. Consequently, it does not happen that the toner concentrates on a portion of the toner charging control means 3*h*, and the general regular polarity charging process for the untransferred toner by the toner charging control means 3*h* is always sufficiently carried out, whereby the prevention of the adherence of the untransferred toner to the charging roller 3*a* is done effectively. Also, the occurrence of a ghost image of an untransferred toner image pattern is prevented.

In the present embodiment, the untransferred toner uniformizing means 3*g* and the toner charging control means 3*h* are brush-like members having moderate electrical conductivity, and are disposed with their brush portions brought into contact with the surface of the photosensitive drum.

Also, these means are adapted to be moved (reciprocally moved)l in the longitudinal direction of the photosensitive drum by a drive source, not shown. By doing so, it never happens that the untransferred toner uniformizing means 3*g* and the toner charging control means 3*h* continue to lie at the same location on the photosensitive drum. For example, even if there is present an excessively charged portion or an insufficiently charged portion by the uneven resistance of the toner charging control means 3*h*, it does not occur always on the same portion of the surface of the photosensitive drum. Consequently, the occurrence of the fusion of the untransferred toner onto the photosensitive drum, due to minimum excessive charging of the untransferred toner, and the adherence of the untransferred toner to the charging roller 3*a*, due to the deficiency of charging, are prevented or alleviated.

<Exposure Means>

In the present embodiment, the exposure of the photosensitive drum 2 is effected by the use of laser exposure means. That is, when an image signal is sent from the image forming apparatus main body, the uniformly charged surface of the photosensitive drum 2 is scanned by and exposed to a laser beam L, modulated in correspondence to this image signal. Then, an electrostatic latent image corresponding to image information is selectively formed on the surface of the photosensitive drum 2.

The laser exposure means is comprised of a solid state laser element (not shown), a polygon mirror 51*a*, an imaging lens 51*b*, a reflecting mirror 51*c*, etc. On the basis of the inputted image signal, the solid state laser element is ON/OFF controlled at a predetermined timing by a light emission signal generator (not shown). The laser beam L emitted from the solid state laser element is converted into a substantially parallel beam by a collimator lens system (not shown), and is scanned by the polygon mirror 51*a* rotated at a high speed. The beam is then imaged in a spot shape on the photosensitive drum 2 through the intermediary of the imaging lens 51*b* and the reflecting mirror 51*c*.

As described above, the surface of the photosensitive drum 2 is subjected to the exposure in the main scanning direction by the laser beam scanning and further, drum 2 is subjected to exposure in the sub-scanning direction by the photosensitive drum 2 being rotated, whereby an exposure distribution conforming to the image signal is obtained.

That is, by the application and non-application of the laser beam L, there are formed a light portion potential low in surface potential and a dark portion potential which is not. By the contrast between the light portion potential and the dark portion potential, there is formed an electrostatic latent image corresponding to the image information.

<Developing Means>

The developing apparatus 4, which is developing means, is a two-component contact developing apparatus (two-component magnetic brush developing apparatus). As shown in FIG. 2, a developer comprising a carrier and a toner is held on a developing sleeve 4*a* as a developer bearing member including a magnet roller 4*b* therein. A regulating blade 4*c* is provided on the developing sleeve 4*a* with a predetermined gap therebetween, and forms a thin layer of developer on the developing sleeve 4*a* with the rotation of the developing sleeve 4*a* in the direction of the arrow.

The developing sleeve 4*a*, as shown in FIG. 3, is disposed so as to have a predetermined gap between it and the photosensitive drum 2 by spacers 4*k* being rotatably fitted to journalled portions 4*a*1 of a reduced diameter at the opposite ends of the developing sleeve. The developing sleeve 4*a* is set such that during development, the developer formed on the developing sleeve 4*a* can develop while being in contact with the photosensitive drum 2. The developing sleeve 4*a* is rotatably driven at a predetermined peripheral speed in the clockwise direction of the arrow (FIG. 2) which is a counter direction to the direction of rotation of the photosensitive drum 2 in the developing portion.

The toner used in the present embodiment is a negatively charged toner having an average particle diameter of 6 $\mu$m, and as the magnetic carrier, use is made of a magnetic carrier having an average particle diameter of 35 $\mu$m and having saturated magnetization having a magnetized amount of 56.9 $Am^2/kg$ (specific gravity of 3.6 $g/cm^3$) per 205 $emu/cm^3$ (1000 gauss (0.1T)). Also, a mixture of the toner and the carrier at a weight ratio of 6:94 is used as the developer.

A developer containing portion 4*h* in which the developer is circulated is comported into two by a lengthwise partition wall 4*d* except for the opposite end portions thereof. An agitating screw 4*e*A as a developer conveying member and an agitating screw 4*e*B as a powder agitating and conveying member, which is a characteristic construction of the present embodiment, are disposed with the partition wall 4*d* interposed therebetween. The agitating screw 4*e*B serves to agitate and convey the toner as powder, and will be described later in detail.

The toner supplied from a toner supply container, as shown in FIG. 3, falls onto the inner part side of the agitating screw 4*e*B and is agitated while being conveyed to the lengthwise front side thereof, and passes the front side end portion thereof, which is free of the partition wall 4*d*. The toner is further conveyed to the lengthwise inner part side by the agitating screw 4*e*A and passes the inner part side portion that is free of the partition wall 4*d*, and is agitated while being conveyed by the agitating screw 4*e*B, and repeats its circulation.

A description will now be provided of the developing step of visualizing the electrostatic latent image formed on the photosensitive drum 2 by a two-component magnetic brush method by the use of the developing apparatus 4 and a developer circulating system.

With the rotation of the developing sleeve 4*a*, the developer in a developing container is scooped up to the surface of the developing sleeve 4*a* by the scoop-up pole of the magnet roller 4*b* and is conveyed.

In the process of being conveyed, the developer has its layer thickness regulated by the regulating blade 4*c* disposed perpendicularly to the developing sleeve 4*a*, and a thin layer of developer is formed on the developing sleeve 4*a*. When the thin layer of developer is conveyed to a developing pole corresponding to the developing portion, the ears of the developer are formed by a magnetic force. The electrostatic latent image on the surface of the photosensitive drum 2 is developed as a toner image by the toner in the developer formed in this ear shape. In the present embodiment, the electrostatic latent image is reverse developed.

The thin layer of developer on the developing sleeve 4*a* that has passed the developing portion enters the developing container with the continued rotation of the developing sleeve 4*a*, and is separated from the surface of the developing sleeve 4*a* by the repulsive magnetic field of a conveying pole and is returned to a developer reservoir in the developing container.

A DC voltage and an AC voltage are applied from a voltage source, not shown, to the developing sleeve 4*a*. In the present embodiment, a DC voltage of−500 V and an AC voltage of peak-to-peak voltage 1500 V at a frequency 2000 Hz are applied, and only the exposed portion of the photosensitive drum 2 is selectively developed.

Generally in the two-component developing method, when an AC voltage is applied, developing efficiency is increased and an image becomes high in quality, but conversely, there occurs the danger that fog becomes liable to occur. Therefore, usually, a potential difference is provided between the DC voltage applied to the developing sleeve 4*a* and the surface potential of the photosensitive drum 2 to thereby realize the prevention of the fog. More specifically, a bias voltage of the potential between the potential of the exposed portion of the photosensitive drum 2 and the potential of the non-exposed portion of the photosensitive drum is applied.

When the toner is consumed by development, the density of the toner in the developer is lowered. In the present embodiment, a sensor 4*g* for detecting the toner density is disposed at a location proximate to the outer peripheral surface of the agitating screw 4*e*B. When the sensor 4*g* detects that the toner density in the developer has become lower than a predetermined density level, a command for supplying the toner from the toner supply container into the developing apparatus 4 is outputted. By this toner supplying operation, the toner density in the developer is always controlled so as to be maintained at a predetermined level.

<Toner Supplying Container>

The toner supply containers 5 (5Y, 5M, 5C and 5K) are juxtaposed above the process cartridges 1Y, 1M, 1C and 1K, and are mounted from the front of the image forming apparatus main body 100.

As shown in FIG. 2, an agitating plate 5*b* fixed to an agitating shaft 5*c* and a screw 5*a* are disposed in the toner supply container 5, and a discharge opening portion 5*f* for discharging the toner therethrough is formed in the bottom surface of the toner supply container.

The screw 5*a* and the agitating shaft 5*c* have their opposite ends rotatably supported by bearings, not shown, and a driving coupling (concave), not shown, is disposed on the endmost portion of one of them. The outer diameter portion of the screw 5*a* is of a spiral rib shape, and the direction of distortion of the spiral is reversed about the discharge opening portion 5*f*. By the rotation of a driving coupling (convex), not shown, the screw 5*a* is rotated in a predetermined direction of rotation. The toner is conveyed toward the discharge opening portion 5*f*, and the toner is freely dropped from the opening of the discharge opening portion 5*f*, and the toner is supplied to the process cartridge through a supply opening portion 1*b* connected to the discharge opening portion 5*f*.

The distal end portion of the agitating plate 5*b* in the rotational radial direction thereof is inclined and when it rubs against the wall surface of the toner supply container 5, the above-mentioned distal end portion abuts against the wall surface at a certain angle. Specifically, the distal end side of the agitating plate 5*b* is distorted into a spiral state.

As described above, the distal end side of the agitating plate 5*b* is distorted and inclined, whereby a conveying force in the axial direction thereof is created and the toner is conveyed in the lengthwise direction thereof.

The toner supply container in the present embodiment is not restricted to the two-component developing method, but can also supply the toner in a process cartridge or a developing cartridge using a single-component developing method. The powder contained in the toner supply container is not limited to the toner, but may be a mixture of the toner and a magnetic carrier.

<Transfer Means>

An intermediate transfer unit 54 which is transferring means, serves to collectively secondary-transfer a plurality of toner images successively primary-transferred from the photosensitive drums 2 and superimposed one upon another, to the recording medium 52.

The intermediate transfer unit 54 is provided with an intermediate transfer belt 54*a* moved in the direction of an arrow shown in FIG. 1, and is moved at substantially the same peripheral speed as the outer peripheral speed of the photosensitive drums 2 in the clockwise direction of the arrow. The intermediate transfer belt 54*a* is an endless belt having a circumferential length of about 940 mm, and is passed over three rollers, i.e., a driving roller 54*b*, a secondary transfer opposed roller 54*g* and a driven roller 54*c*.

Further inside the intermediate transfer belt 54*a*, transfer charging rollers 54*f*Y, 54*f*M, 54*f*C and 54*f*K are rotatably disposed at locations opposed to the respective photosensitive drums 2, and are pressed toward the centers of the photosensitive drums 2.

The transfer charging rollers 54*f*Y, 54*f*M, 54*f*C and 54*f*K are supplied with electric power from a high voltage source, not shown. They effect charging opposite in polarity to the toners from the back side of the intermediate transfer belt 54*a* to thereby successively primary-transfer the toner images on the photosensitive drums 2 to the upper surface of the intermediate transfer belt 54*a*.

In a secondary transfer portion, a secondary transfer roller 54*d* as a transfer member is urged against the intermediate transfer belt 54*a* at a location opposed to the secondary transfer opposed roller 54*g*. The secondary transfer roller 54*d* is rockable up and down as viewed in FIG. 1 and is rotatable. At the same time, a bias is applied to the intermediate transfer belt 54*a* and therefore, the toner images on the intermediate transfer belt 54*a* are transferred to the recording medium 52.

The intermediate transfer belt 54*a* and the secondary transfer roller 54*d* are respectively driven. When the recording medium 52 comes into the secondary transfer portion, a predetermined bias is applied to the secondary transfer roller 54*d*, whereby the toner images on the intermediate transfer belt 54*a* are secondary transferred to the recording medium 52.

At this time, the recording medium 52 sandwiched between the two is transported at a predetermined speed in the leftward direction as viewed in FIG. 1 simultaneously with the transferring step being carried out and is transported to a fixing device 56 which is the next step.

At a predetermined location on the intermediate transfer belt 54*a*, which is the most downstream side of the transferring step, there is provided a cleaning unit 55 movable toward and away from the surface of the intermediate transfer belt 54*a*, and it removes any untransferred toners left after the secondary transfer.

A cleaning blade 55*a* for removing the untransferred toners is disposed in the cleaning unit 55. The cleaning unit 55 is mounted for pivotal movement about a center of rotation, not shown, and the cleaning blade 55*a* is brought into pressure contact in a direction to eat into the intermediate transfer belt 54*a*. The untransferred toners introduced into the cleaning unit 55 are conveyed to and stored in a waste toner tank (not shown) by a conveying screw 55*b*.

As the intermediate transfer belt 54*a*, use can be made of one formed of polyimide resin. However, the material of the intermediate transfer belt 54*a* is not limited to polyimide resin, but use can suitably be made of plastic such as polycarbonate resin, polyethylene terephthalate resin, polyvinylidene fluoride resin, polyethylene naphthalate resin, polyether ether ketone resin, polyether sulfone resin or polyurethane resin, or rubber, such as fluorine rubber or silicone resin.

<Fixing Portion>

The toner images formed on the photosensitive drums 2 by the aforedescribed developing means are transferred onto the recording medium 52 through the intermediate transfer belt 54*a*. Then the fixing device 56 fixes the toner images transferred onto the recording medium 52 by the use of heat.

As shown in FIG. 1, the fixing device 56 is provided with a fixing roller 56*a* for applying heat to the recording medium 52, and a pressure roller 56*b* for bringing the recording medium 52 into pressure contact with the fixing roller 56*a*, and each of these rollers is a hollow roller. Each roller has a heater (not shown) therein. These rollers are rotatably driven to thereby transport the recording medium 52.

That is, the recording medium 52 retaining the toner images thereon is transported by the fixing roller 56*a* and the pressure roller 56*b* and has heat and pressure applied thereto, whereby the toner images are fixed on the recording medium 52. The recording medium 52 after the fixing is delivered by delivery rollers 53*h* and 53*j* and is stacked on a tray 57 on the image forming apparatus main body 100.

The features of the present embodiment will now be described.

The present embodiment is such that the shape of the agitating screw described with respect to the foregoing developing means is further improved in agitating capability.

Figure 4:
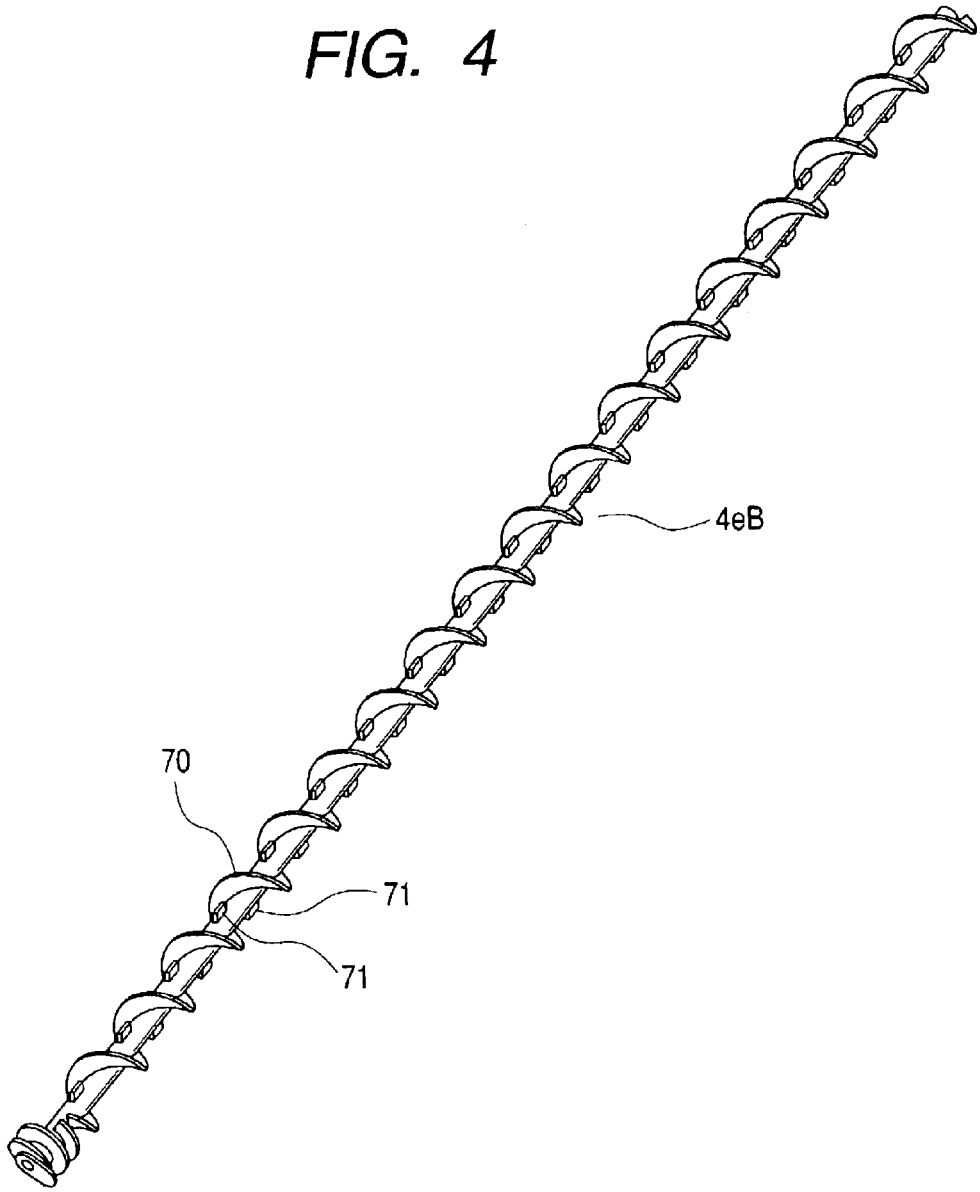
FIG. 4 is a perspective view of a toner conveying screw according to an embodiment of the present invention.
Figure 5D:
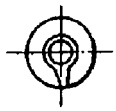
FIGS. 5A, 5B, 5C, 5D and 5E are detailed illustrations of the toner conveying screw according to the embodiment of the present invention.
Figure 5B:
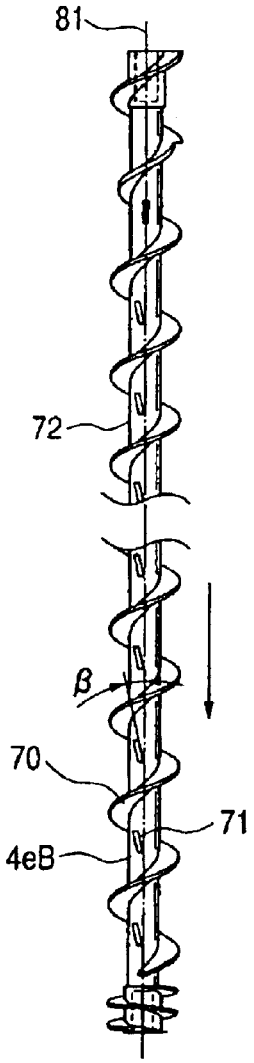
Figure 5A:
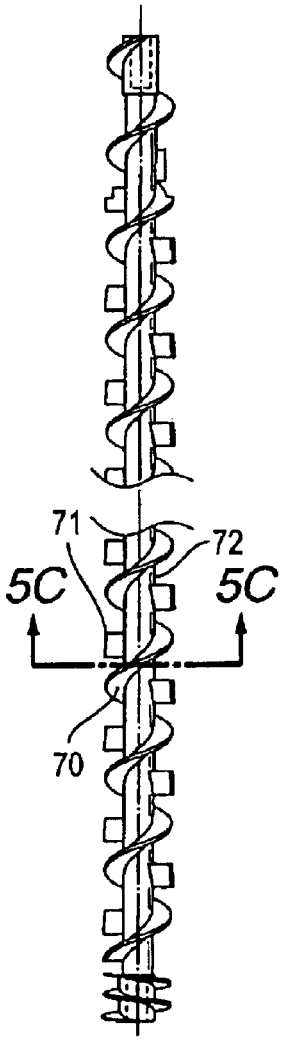
Figure 5C:
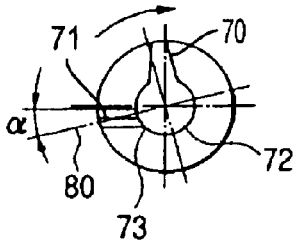
Figure 5E:
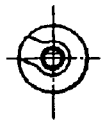

FIG. 4 is a schematic perspective view showing the agitating screw 4*e*B. FIGS. 5A to 5E are schematic views showing the agitating screw 4*e*B, FIG. 5A being a schematic plan view, FIG. 5B being a view of the agitating screw of FIG. 5A as it is seen from its left, FIG. 5C being a cross-sectional view taken along line 5C-5C of FIG. 5A, FIG. 5D is a view of the agitating screw of FIG. 5A as it is seen from above it, and FIG. 5E is a view of the agitating screw of FIG. 5A as it is seen from below it.

The developer is circulated by the agitating screw 4*e*A and the agitating screw 4*e*B. The agitating screw 4*e*B is disposed below the supply opening portion 1*b* through which the toner freely, falling from the opening of the discharge opening portion 5*f*, is supplied and therefore, affects chiefly the agitation of the toner.

The agitating screw 4*e*A is located near the developing sleeve 4*a*, and supplies the toner to the developing sleeve 4*a* and effects the collection and conveyance of the developing carrier after development.

A spiral rib 70 having the conveying, capability is disposed at a pitch of about 20 mm on the agitating screw 4*e*B, and as shown in FIGS. 5A and 4, and agitating ribs 71 are disposed in the spiral rib 70 while being 180° out of phase with respect to one another. The agitating rib 71, when seen in the cross section 5C-5C as shown in FIG. 5C, is inclined by a degrees from the outer peripheral portion 73 of a screw shaft 72 of about $\phi$6 mm toward the direction of rotation (the arrow in the figure) with respect to a radial line 80. In the present embodiment, $\alpha$=15°. Also, when the agitating screw 4*e*B is seen from FIG. 5B, the agitating rib 71 is inclined in a direction substantially orthogonal to the spiral direction (spiral angle) of the spiral rib 70, which is a direction to catch the toner, with respect to an axial line 81, which is the center (axial direction) of the screw shaft 72. The angle of inclination $\beta$ of the agitating rib 71 at that time with respect to the axial line 81 is about 11°.

By the agitating ribs 71 inclined as previously described being provided, the agitating ribs 71 become capable of catching, like a paddle, for example, the toner being conveyed by the agitating screw 4*e*B. The toner conveyed by only the spiral ribs 70 is caught by the agitating ribs 71, whereby the toner can be efficiently agitated.

Therefore, even when the rotation (the rotated state and the rotational speed) of the agitating screw 4*e*B is the same as that in the conventional type, the toner agitating capability can be improved without decreasing the toner conveying force, as compared with a conventional agitating screw having no agitating ribs 71 as opposed to the agitating screw 4*e*B.

Accordingly, the toner can be efficiently agitated and conveyed within a short time, and even in an image forming apparatus for effecting high-speed printing, stable agitation and conveyance of the developing toner can be accomplished and stable images can be provided.

As described above, according to the present invention, the developer can be efficiently agitated and conveyed. Also when the present invention is applied to a high-speed image forming apparatus, stable agitation and conveyance of the developer are effected.

What is claimed is:

1. An agitating and conveying member for agitating and conveying a developer contained in a developer containing portion, said agitating and conveying member comprising:

a shaft portion rotatable in a rotation direction;

a spiral rib protruding from an outer peripheral surface of said shaft portion and having a spiral shape; and an inclined rib protruding from the outer peripheral surface of said shaft portion, said inclined rib being provided at a position on the outer peripheral surface of said shaft portion other than where said spiral rib is provided on the outer peripheral surface of said shaft portion, and said inclined rib extending in an axial direction of said shaft portion, wherein said inclined rib is configured to be inclined toward the rotation direction of said shaft portion with respect to an imaginary line extending in a radial direction of said shaft portion, and wherein said inclined rib extends along a direction substantially orthogonal to the spiral angle of said spiral rib.

2. An agitating and conveying member according to claim 1, wherein said shaft portion has a circular cross-sectional shape.

3. An agitating and conveying member according to claim 1, further comprising another inclined rib adjacent to said inclined rib in said axial direction and protruding from the outer peripheral surface of said shaft portion while being about 180° out of phase with said inclined rib.

4. An agitating and conveying member according to claim 1, wherein said agitating and conveying member agitates and conveys a two-component developer including a toner and a carrier.

5. An agitating and conveying member according to claim 1, wherein said inclined rib is configured to be inclined by about 15° toward the rotation direction of said shaft portion with respect to the imaginary line of the radial direction of said shaft portion.

6. A developing apparatus detachably mountable on an image forming apparatus main body, said developing apparatus comprising:

a developing member configured and positioned to develop a latent image formed on an electrophotographic photosensitive member;

a developer containing portion containing therein a developer for developing the latent image on the electrophotographic photosensitive member; and an agitating and conveying member configured and positioned to agitate and convey the developer contained in said developer containing portion, said agitating and conveying member comprising:

a shaft portion rotatable in a rotation direction;

a spiral rib protruding from an outer peripheral surface of said shaft portion and having a spiral shape; and an inclined rib protruding from the outer peripheral surface of said shaft portion, said inclined rib being provided at a position on the outer peripheral surface of said shaft portion other than where said spiral rib is provided on the outer peripheral surface of said shaft portion, and said inclined rib extending in an axial direction of said shaft portion, wherein said inclined rib is configured to be inclined toward the rotation direction of said shaft portion with respect to an imaginary line a radial direction of said shaft portion, and wherein said inclined rib extends along a direction substantially orthogonal to the spiral angle of said spiral rib.

7. A developing apparatus according to claim 6, wherein said shaft portion has a circular cross-sectional shape.

8. A developing apparatus according to claim 6, wherein said agitating and conveying member further comprises another inclined rib adjacent to said inclined rib in said axial direction and protruding from the outer peripheral surface of said shaft portion while being about 180° out of phase with said inclined rib.

9. A developing apparatus according to claim 6, wherein said agitating and conveying member agitates and conveys a two-component developer comprising a toner and a carrier.

10. A developing apparatus according to claim 6, wherein said inclined rib is inclined by about 15° in the rotation direction of said shaft portion with respect to the imaginary line of the radial direction of said shaft portion.

11. A process cartridge detachably mountable on an image forming apparatus main body, said process cartridge comprising:

an electrophotographic photosensitive member;

a developing member configured and positioned to develop a latent image formed on said electrophotographic photosensitive member;

a developer containing portion containing therein a developer for developing the latent image on said electrophotographic photosensitive member; and an agitating and conveying member configured and positioned to agitate and convey the developer contained in said developer containing portion, said agitating and conveying member comprising:

a shaft portion rotatable in a rotation direction;

a spiral rib protruding from an outer peripheral surface of said shaft portion and having a spiral shape; and an inclined rib protruding from the outer peripheral surface of said shaft portion, said inclined rib being provided at a position on the outer peripheral surface of said shaft portion other than where said spiral rib is provided on the outer peripheral surface of said shaft portion, said inclined rib extending in an axial direction of said shaft portion, wherein said inclined rib is configured to be inclined toward the rotation direction of said shaft portion with respect to an imaginary line of a radial direction of said shaft portion, and wherein said inclined rib extends along a direction substantially orthogonal to the spiral angle of said spiral rib.

12. A process cartridge according to claim 11, wherein said shaft portion has a circular cross-sectional shape.

13. A process cartridge according to claim 11, wherein said agitating and conveying member further comprises another inclined rib adjacent to said inclined rib in said axial direction and protruding from the outer peripheral surface of said shaft portion while being about 180° out of phase with said inclined rib.

14. A process cartridge according to claim 11, wherein said agitating and conveying member agitates and conveys a two-component developer comprising a toner and a carrier.

15. A process cartridge according to claim 11, wherein the said inclined rib is inclined by about 15° in the rotation direction of said shaft portion with respect to the imaginary line of the radial direction of said shaft portion.

16. An image forming apparatus on which a developing apparatus is detachably mountable and for forming an image on a recording medium, said image forming apparatus comprising:

(i) a mounting portion;

(ii) a developing apparatus detachably mounted on said mounting portion, and comprising:

a developing member configured and positioned to develop a latent image formed on an electrophotographic photosensitive member;

a developer containing portion containing therein a developer for developing the latent image on the electrophotographic photosensitive member; and an agitating and conveying member comprising:

a shaft portion rotatable in a rotation direction;

a spiral rib protruding from an outer peripheral surface of said shaft portion and having a spiral shape; and an inclined rib protruding from the outer peripheral surface of said shaft portion, said inclined rib being provided at a position on the outer peripheral surface of said shaft portion other than where said spiral rib is provided on the outer peripheral surface of said shaft portion, said inclined rib extending in an axial direction of said shaft portion, wherein said inclined rib is configured to be inclined toward the rotation direction of said shaft portion with respect to an imaginary line of a radial direction of said shaft portion, and wherein said inclined rib extends along a direction substantially orthogonal to the spiral angle of said spiral rib; and (iii) transporting means for transporting the recording medium.

17. An image forming apparatus on which a process cartridge is detachably mountable and for forming an image on a recording medium, said image forming apparatus comprising:

(i) a mounting portion;

(ii) a process cartridge detachably mounted on said mounting portion, and comprising:

an electrophotographic photosensitive member;

a developing member configured and positioned to develop a latent image formed on said electrophotographic photosensitive member;

a developer containing portion containing therein a developer for developing the latent image on said electrophotographic photosensitive member; and an agitating and conveying member configured and positioned to agitate and convey the developer contained in said developer containing portion, said agitating and conveying member comprising:

a shaft portion rotatable in a rotation direction;

a spiral rib protruding from an outer peripheral surface of said shaft portion and having a spiral shape; and an inclined rib protruding from the outer peripheral surface of said shaft portion, said inclined rib being provided at a position on the outer peripheral surface of said shaft portion other than where said spiral rib is provided on the outer peripheral surface of said shaft portion, said inclined rib extending in an axial direction of said shaft portion, wherein said inclined rib is configured to be inclined toward the rotation direction of said shaft portion with respect to an imaginary line of a radial direction of said shaft portion, and wherein said inclined rib extends along a direction substantially orthogonal to the spiral angle of said spiral rib; and (iii) transporting means for transporting the recording medium.

* * * * *

UNITED STATES PATENT AND TRADEMARK OFFICE

CERTIFICATE OF CORRECTION

PATENT NO. : 6,834,175 B2
DATED : December 21, 2004
INVENTOR(S) : Kazunari Murayama et al.

It is certified that error appears in the above-identified patent and that said Letters Patent is hereby corrected as shown below:

Column 7,
Line 28, “moved)1” should read -- moved) --.

Column 11,
Line 65, “toner freely,” should read -- toner, Freely --.

Column 12,
Line 5, “conveying,” should read -- conveying --.
Line 7, “and” (third occurence) should be deleted.
Line 11, “a” (first occurrence) should read -- α --.

Signed and Sealed this

Third Day of May, 2005

JON W. DUDAS
*Director of the United States Patent and Trademark Office*